US006682391B2

(12) United States Patent
Yu

(10) Patent No.: US 6,682,391 B2
(45) **Date of Patent: *Jan. 27, 2004**

(54) TRANSMISSION MECHANISM FOR DOLL

(76) Inventor: Jui Hsia Yu, 2F, No. 294, Sec. 1, Dun Hua S. Rd., Taipei 106 (TW)

( * ) Notice: Subject to any disclaimer, the term of this patent is extended or adjusted under 35 U.S.C. 154(b) by 0 days.

This patent is subject to a terminal disclaimer.

(21) Appl. No.: 10/162,390

(22) Filed: May 30, 2002

(65) Prior Publication Data

US 2003/0232569 A1 Dec. 18, 2003

(51) Int. Cl.[7] ..... A63H 11/00; A63H 13/00; A63H 3/20

(52) U.S. Cl. ..... 446/330; 446/338; 446/354

(58) Field of Search ..... 446/330, 338, 446/300, 335, 352, 353, 354, 391, 395

(56) References Cited

U.S. PATENT DOCUMENTS 1,576,789 A * 3/1926 Robertson
3,964,205 A * 6/1976 Kuramochi
4,911,676 A * 3/1990 Fan ..... 446/300
6,589,095 B1 * 7/2003 Tsai ..... 446/330

* cited by examiner

*Primary Examiner*—Derris H. Banks
*Assistant Examiner*—Ali F Abdelwahed
(74) *Attorney, Agent, or Firm*—Rosenberg, Klein & Lee

(57) ABSTRACT

A transmission mechanism for a doll is arranged on a top stage of the doll and comprises a motor fixed to the top stage, a pulley set linked to the motor, a gear set having a plurality of gears and linked to the pulley set, a link having one end eccentrically connected to one gear in the gear set, and a swing rod pivotally arranged on the top stage by a center part thereof. The link has another end connected to the swing rod and the swing rod has two limbs on two opposite ends thereof. The limbs have alternative swing motion due to a seesaw motion of the swing rod. Therefore, the arms of the doll can be swung lively by the limbs.

7 Claims, 4 Drawing Sheets

TRANSMISSION MECHANISM FOR DOLL

FIELD OF THE INVENTION

The present invention relates to a transmission mechanism for a doll, especially to a transmission mechanism for a doll whereby the arms of the doll alternatively swing.

BACKGROUND OF THE INVENTION

Dolls are generally used as toys for children or ornamental purposes in a house or store. However, the conventional dolls generally have fixed limbs, or the limbs of the dolls cannot be moved in a lively way.

SUMMARY OF THE INVENTION

It is an object of the present invention to provide a transmission mechanism for a doll whereby the arms of the doll alternatively swing.

It is another object of the present invention to provide a transmission mechanism for a doll wherein the head portion of the doll can be easily assembled or detached.

To achieve the above object, the present invention provides a transmission mechanism for doll, which is arranged on a top stage of the doll and comprises a motor fixed to the top stage, a pulley set linked to the motor, a gear set having a plurality of gears and linked to the pulley set, a link having one end eccentrically connected to one gear in the gear set, and a swing rod pivotally arranged on the top stage by a center part thereof. The link has another end connected to the swing rod and the swing rod has two limbs on two opposite ends thereof. The motor generates a power transmitted to the swing rod through the pulley set, the gear set and the link, whereby the two limbs are driven to have alternative up and down swing motion.

The various objects and advantages of the present invention will be more readily understood from the following detailed description when read in conjunction with the appended drawings, in which:

DETAILED DESCRIPTION OF THE INVENTION

With reference now to FIGS. 1 to 4, the present invention is intended to provide a transmission mechanism for a doll, the transmission mechanism can be arranged in the doll 100 with human or animal shape. In the preferred embodiment, the doll 100 is a Santa Claus with the bottom thereof fixed to a base 10. The base 10 is connected to a top stage 30 on the top thereof through at least one post 20. The doll 100 has a top portion fixed to the top stage 30, whereby the doll 100 is arranged outside of the top stage 30 and the post 20.

Figure 1:
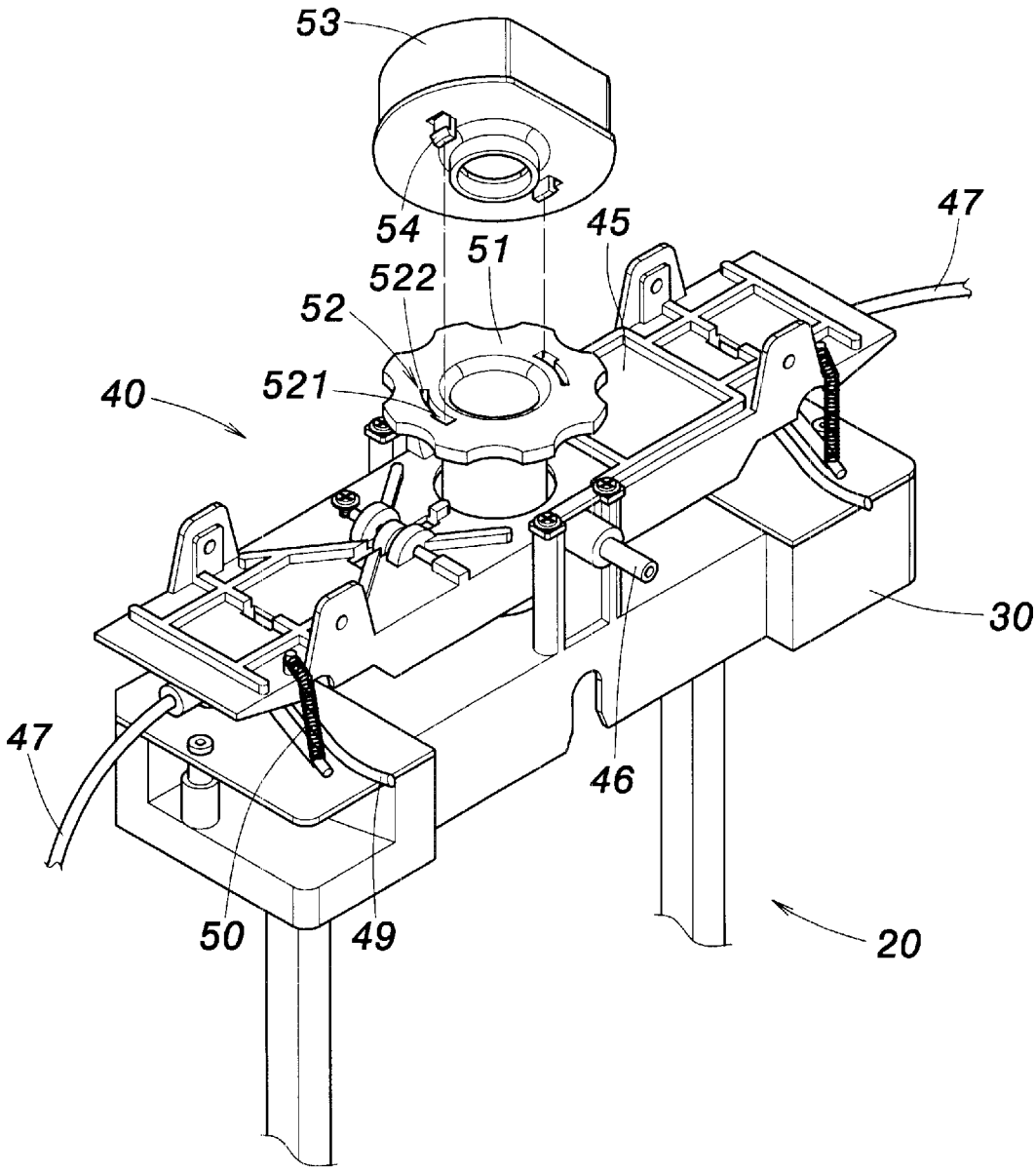
FIG. 1 shows a perspective view of the present invention.
Figure 2:
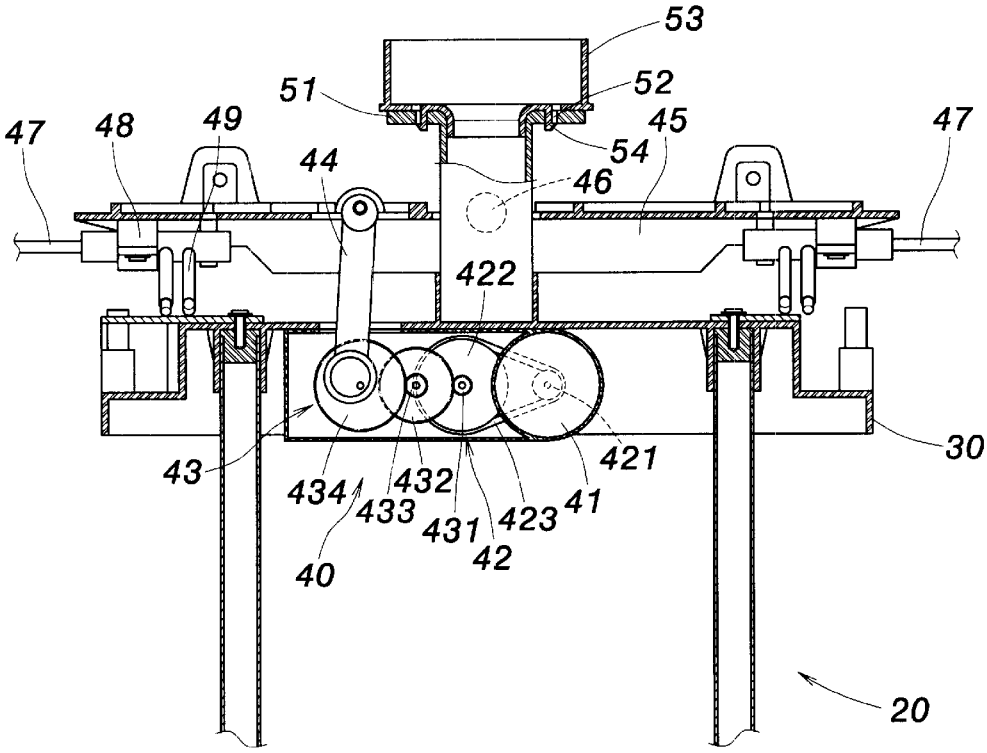
FIG. 2 shows a sectional view of the present invention.

With reference to FIGS. 1 and 2, the transmission mechanism 40 of the present invention is arranged on the top stage 30 and is composed of a motor 41, a pulley set 42, a gear set 43, a link 44 and a swing rod 45. The motor 41 is placed in the top stage 30 with its axis connected to the pulley set 42.

The pulley set 42 comprises a first pulley 421, a second pulley 422 and a belt 423. The first pulley 421 is fixed to the axis of the motor 41 and the second pulley 422 is connected to the gear set 43, whereby the power of the motor 41 is transmitted to the gear set 43 through the first pulley 421, the belt 423 and the second pulley 422.

The gear set 43 is composed of a plurality of gears including a first gear 431, a second gear 432, a third gear 433 and a fourth gear 434. Those gears are pivotally arranged in the top stage 30. More particularly, the first gear 431 is concentric with the second pulley 422 such that the pulley set 42 and the gear set 43 are linked. The first gear 431 has synchronous rotation with the second pulley 422 and is engaged with the second gear 432. The second gear 432 is concentric with the third gear 433 and has synchronous rotation with the third gear 433. The third gear 433 is engaged with the fourth gear 434. The gear set 43 is a decelerating gear set through which the power of the motor 41 is transmitted to the link 44.

The link 44 has one end eccentrically connected to the fourth gear 434. The swing rod 45 is pivotally connected to the top stage 30 through a pivot 46 at the center thereof such that the swing rod 45 has seesaw motion with respect to the top stage 30. The link 44 has another end connected to the swing rod 45.

Figure 3:
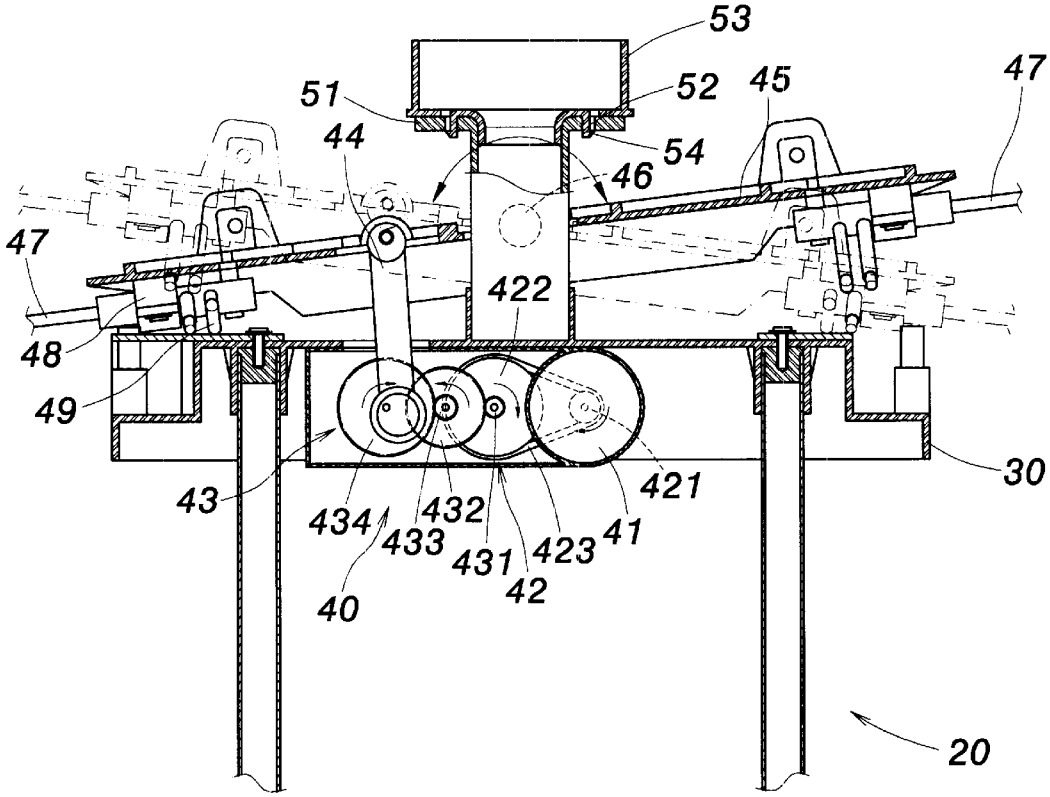
FIG. 3 shows the movement of the present invention.
Figure 4:
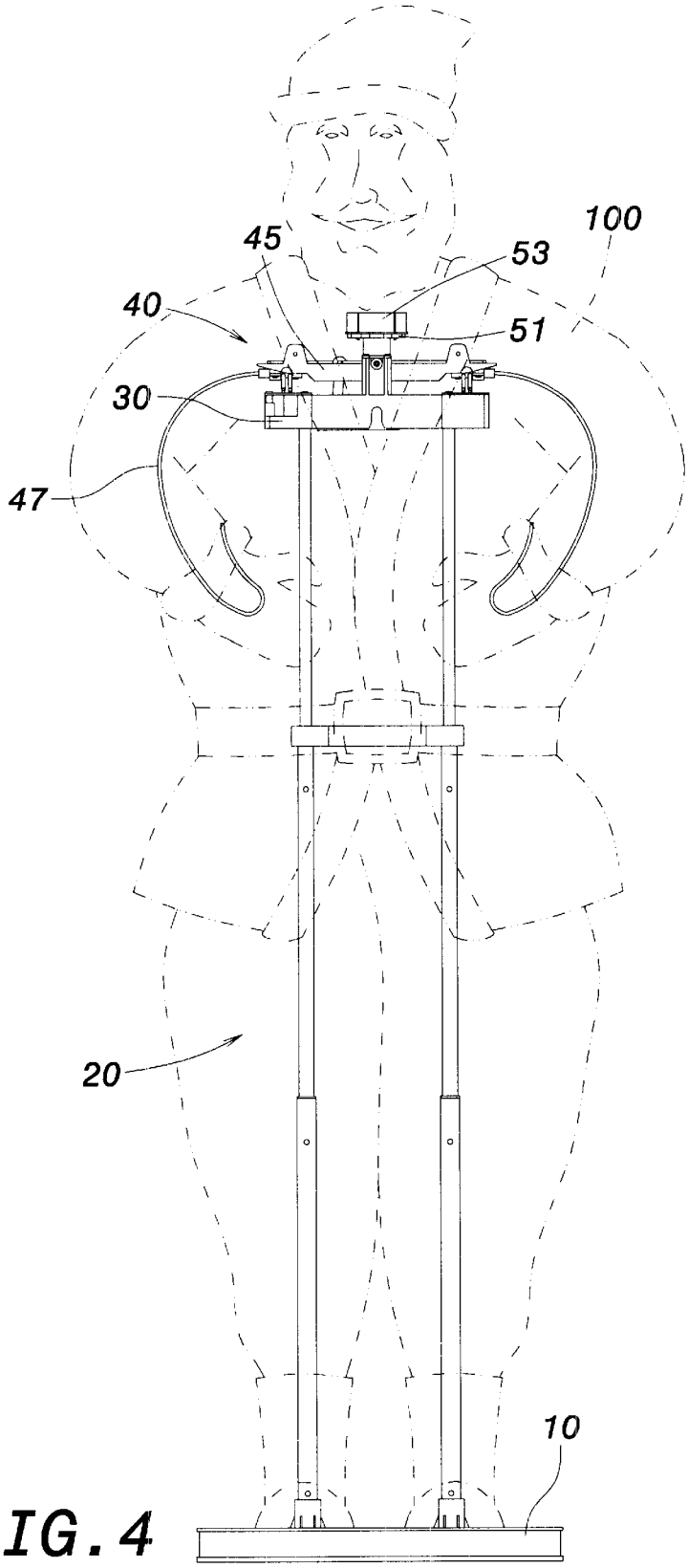
FIG. 4 shows the present invention applied to a doll.

When the power of the motor 41 is transmitted to the link 44 through the pulley set 42 and the gear set 43, the link 44 drives the swing rod 45 to have seesaw motion. Two limbs 47 are connected to two sides of the swing rod 45 and have alternative swing motion due to the seesaw motion of the swing rod 45, as shown in FIG. 3. The two limbs 47 are arranged in two arms of the doll 100 such that the two arms of the doll 100 have alternative swing motion. For example, when the right arm of the doll 100 swings up, the left arm of the doll 100 swings down, and vice versa.

Each of the limbs 47 has a pivotal end connected to a pivotal stage 48 arranged on the swing rod 45 and has a pusher 49 near the pivotal end. The limb 47 has azimuth rotation when the pusher 49 is subjected to a pushing force. The two pushers 49 are placed atop the top stage 30. Moreover, a spring 50 is connected between the limb 47 and one end of the swing rod 45 to resiliently clamp the limb 47.

When the swing rod 45 is swung up and down, the downward moved end of the swing rod 45 drives the pusher 49 to abut against the top stage 30, as shown in FIG. 3. Therefore, the limb 47 on the downward end of the swing rod 45 is rotated in azimuth direction, and the limb 47 on the opposite end (upward end) of the swing rod 45 is raised. The pusher 49 on the upward end of the swing rod 45 is separated with the top stage 30 and the upward end of the swing rod 45 is subjected to a restoring force exerted by the spring 50. In this way, the limbs 47 have alternative swing motion and the arms of the doll also have alternative swing motion.

The transmission mechanism of the present invention can provide alternative swing motion for the arms of a doll in a human or animal shape, whereby the movement of the doll is more lively.

Moreover, a fixed stage 51 is fixedly arranged on the swing rod 45 and has two locking grooves 52. Each of the locking grooves 52 has a wider portion 521 and a narrower portion 522. A movable stage 53 is provided atop the fixed stage 51 and has two locking hooks 54. The two locking hooks 54 are firstly inserted into the wider portions 521 of the fixed stage 51. Afterward, the movable stage 53 is such rotated that the locking hooks 54 are engaged into the narrower portions 522. In this way, the movable stage 53 is detachably assembled to the fixed stage 51. In application, the movable stage 53 is assembled to a head portion of the doll 100 in advance, and the head of the doll 100 can be locked to the swing rod 45 atop the post 20. Therefore, the head of the doll 100 can be easily assembled and detached.

Although the present invention has been described with reference to the preferred embodiment thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

I claim:

1. A transmission mechanism for a doll, which is arranged on a top stage of the doll and comprises:

a motor fixed to the top stage;

a pulley set linked to the motor;

a gear set having a plurality of gears and linked to the pulley set;

a link having one end eccentrically connected to one gear in the gear set; and a swing rod pivotally arranged on the top stage by a center part thereof, the link having another end connected to the swing rod, and the swing rod having at least one limb on each of two opposite ends thereof;

the motor generating a power transmitted to the swing rod through the pulley set, the gear set and the link, whereby two limbs are driven to have alternative up and down swing motion.

2. The transmission mechanism for a doll as in claim 1, wherein the doll is assembled to a base by a bottom portion thereof, the top stage being supported atop the base through at least one post, the doll being mounted on the top stage and enclosing the top stage and the post.

3. The transmission mechanism for a doll as in claim 1, wherein the pulley set comprises a first pulley, a second pulley and a belt, the first pulley being fixed to an axis of the motor and the second pulley being connected to the gear set, the belt linking the first pulley and the second pulley, whereby the power of the motor is transmitted to the gear set through the first pulley, the belt and the second pulley.

4. The transmission mechanism for a doll as in claim 1, wherein the gear set includes a first gear, a second gear, a third gear and a fourth gear pivotally arranged on the top stage, the first gear being linked to the pulley set and engaged with the second gear, the second gear being concentric with the third gear, the third gear being engaged with the fourth gear, the link being eccentrically connected to the fourth gear.

5. The transmission mechanism for a doll as in claim 1, wherein the swing rod has one limb on each of the two opposite ends thereof.

6. The transmission mechanism for a doll as in claim 1, wherein each of the limbs has a pivotal end connected to a pivotal stage arranged on the swing rod and has a pusher near the pivotal end and atop the top stage, a spring being connected between the limb and one end of the swing rod to resiliently clamp the limb, when the two limbs have alternative up and down swing motion, the pusher being moved to abut the top stage to rotate the limb in an azimuth direction.

7. The transmission mechanism for a doll as in claim 1, wherein a fixed stage is fixedly arranged on the swing rod and has two locking grooves, each of the locking grooves having a wider portion and a narrower portion, a movable stage being provided atop the fixed stage and having two locking hooks, the two locking hooks being firstly inserted into the wider portions of the fixed stage and then the movable stage being rotated such that the locking hooks are engaged into the narrower portions.

* * * * *